US010345756B2

(12) United States Patent
Matsumaru et al.

(10) Patent No.: US 10,345,756 B2
(45) Date of Patent: Jul. 9, 2019

(54) DEVELOPING APPARATUS HAVING A SEALED DEVELOPER BEARING MEMBER, PROCESS CARTRIDGE, AND IMAGE FORMING APPARATUS

(71) Applicant: CANON KABUSHIKI KAISHA, Tokyo (JP)

(72) Inventors: Naoki Matsumaru, Suntou-gun (JP); Daisuke Makiguchi, Izunokuni (JP); Go Torii, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 79 days.

(21) Appl. No.: 15/613,322

(22) Filed: Jun. 5, 2017

(65) Prior Publication Data

US 2017/0357208 A1 Dec. 14, 2017

(30) Foreign Application Priority Data

Jun. 14, 2016 (JP) ..... 2016-118005

(51) Int. Cl.

| | |
|---|---|
| ***G03G 21/18*** | (2006.01) |
| ***G03G 15/08*** | (2006.01) |
| ***G03G 15/01*** | (2006.01) |

(52) U.S. Cl.

CPC ..... *G03G 21/18* (2013.01); *G03G 15/0131* (2013.01); *G03G 15/0817* (2013.01); *G03G 15/0881* (2013.01); *G03G 15/0884* (2013.01); *G03G 15/0891* (2013.01); *G03G 21/181* (2013.01)

(58) Field of Classification Search

CPC .. G03G 21/18; G03G 21/181; G03G 15/0817; G03G 15/0881; G03G 15/0131; G03G 15/0891; G03G 15/0884

See application file for complete search history.

(56) References Cited

U.S. PATENT DOCUMENTS 9,513,578 B2 12/2016 Toriie et al.
2013/0084098 A1* 4/2013 Kanazawa ..... G03G 15/0817 399/103

FOREIGN PATENT DOCUMENTS

JP 2007-025345 A 2/2007

* cited by examiner

*Primary Examiner* — G. M. A Hyder
(74) *Attorney, Agent, or Firm* — Venable LLP

(57) ABSTRACT

A process cartridge of an image forming apparatus includes a seal member to seal a first gap between an end portion of a developer bearing member and a frame, and a sealing portion that seals a second gap between the frame and an end portion of the seal member. The frame includes an injection inlet through which elastomer has been injected into the second gap for forming the sealing portion, a storage portion that is a space surrounded by a second surface of the frame and a wall protruding from the second surface and in which elastomer spilling out of the second gap is stored, and a protruding portion that protrudes, from the second surface of the frame, further than the wall of the storage portion. The protruding portion contacts a conveyed recording medium when the process cartridge is mounted in an apparatus main body of the image forming apparatus.

14 Claims, 12 Drawing Sheets

H – H

DEVELOPING APPARATUS HAVING A SEALED DEVELOPER BEARING MEMBER, PROCESS CARTRIDGE, AND IMAGE FORMING APPARATUS

BACKGROUND OF THE INVENTION

Field of the Invention

The present invention relates to a developing apparatus that develops an electrostatic latent image formed on a photosensitive drum, a process cartridge that forms a developer image on the photosensitive drum and is detachably attached to an apparatus main body of an image forming apparatus, and the image forming apparatus that forms an image on a recording medium by using a developer.

Description of the Related Art

Conventionally, in an image forming apparatus that uses electrophotographic techniques, a photosensitive drum charged by a charging roller is exposed by an exposure apparatus, and an electrostatic latent image is thereby formed on the photosensitive drum. The electrostatic latent image formed on the photosensitive drum is developed as a toner image by a developing apparatus, and the toner image on the photosensitive drum is transferred to a sheet such as a paper sheet. Subsequently, the toner image transferred to the sheet is fixed to the sheet by being heated and pressurized by a fixing apparatus.

Herein, in recent years, the charging roller, the photosensitive drum, the developing apparatus and the like are integrated as a process cartridge in the image forming apparatus. In addition, the process cartridge is detachably attached to the apparatus main body of the image forming apparatus. With this, by replacing the process cartridge, it is possible to perform, for example, replacement of process means such as the photosensitive drum and addition of toner. According to the process cartridge system described above, a user can perform the maintenance of the image forming apparatus, and hence it is possible to easily perform the maintenance of the image forming apparatus.

Herein, the frame of the developing apparatus in the process cartridge is conventionally formed by coupling a first frame and a second frame. In addition, by coupling the first frame and the second frame, a toner storage portion in which toner is stored, a developing chamber in which a developing roller is disposed, and an opening for conveying the toner from the toner storage portion to the developing chamber are formed in the developing apparatus. Further, conventionally, a seal member is provided in a gap between the developing roller and the frame in the vicinity of each of both end portions in the direction of the rotation center axis of the developing roller such that the toner does not leak from the gap between the developing roller and the frame.

In addition, conventionally, due to the displacement of the position of the seal member relative to the frame that is caused when the developing apparatus is assembled and the tolerance of the seal member, a gap has been formed between the seal member and the frame. To cope with this, in a technique disclosed in Japanese Patent Application Laid-open No. 2007-025345, in order to seal the gap between the seal member and the frame, elastomer is injected into the gap between the seal member and the frame. Specifically, an injection inlet for injecting liquid elastomer is provided in the frame, and the elastomer is poured into the gap between the seal member and the frame by injecting the elastomer into the injection inlet.

In the case of this configuration, it is proposed to adopt a configuration in which a fence for storing the elastomer spilling out of the injection inlet is provided (Japanese Patent Application Laid-open No. 2007-025345). The elastomer having spilled out of the injection inlet is stored in the fence provided around the injection inlet. With this, the injected elastomer is prevented from jutting out from the contour of the frame.

In recent years, the size of the image forming apparatus has been reduced. In order to reduce the size of the image forming apparatus, it is conceivable to adopt a configuration in which the fence for storing the elastomer is exposed to the path of the sheet conveyed in the image forming apparatus. However, when the elastomer or the fence for storing the elastomer is exposed to the path of the sheet, in the case where the sheet is curled, there is a possibility that the sheet comes into contact with the elastomer or the fence and jamming (paper jamming) is thereby caused.

SUMMARY OF THE INVENTION

In order to achieve the above object, a developing apparatus as the present invention is a developing apparatus forming a developer image with a developer including a developer bearing member that carries the developer, a frame in which the developer bearing member is provided, a seal member that seals a gap between the developer bearing member and the frame such that the developer does not leak from the gap between the developer bearing member and the frame, and a sealing portion that seals a gap between the frame and the seal member such that the developer does not leak from the gap between the frame and the seal member, wherein the frame is provided with an injection inlet for injecting elastomer for forming the sealing portion, a storage portion in which the elastomer spilling out of space in which the sealing portion is formed is stored, and a protruding portion that protrudes toward a conveyance path of a recording medium to which the developer image is transferred, and the protruding portion protrudes toward the conveyance path further than the storage portion exposed to the conveyance path.

In addition, in order to achieve the above object, a process cartridge as the present invention is a process cartridge detachably attached to an apparatus main body of an image forming apparatus, the process cartridge including an image bearing member on which a developer image is formed, a developer bearing member that carries a developer and develops the image bearing member, a frame in which the developer bearing member is provided, a seal member that seals a gap between the developer bearing member and the frame such that the developer does not leak from the gap between the developer bearing member and the frame, and a sealing portion that seals a gap between the frame and the seal member such that the developer does not leak from the gap between the frame and the seal member, wherein the frame is provided with an injection inlet for injecting elastomer for forming the sealing portion, a storage portion in which the elastomer spilling out of space in which the sealing portion is formed is stored, and a protruding portion that protrudes toward a conveyance path of a recording medium to which the developer image is transferred, and the protruding portion protrudes toward the conveyance path further than the storage portion exposed to the conveyance path.

Further, in order to achieve the above object, an image forming apparatus as the present invention is an image forming apparatus including an image bearing member on which a developer image is formed, a developer bearing member that carries a developer and develops the image bearing member, a frame in which the developer bearing member is provided, a seal member that seals a gap between the developer bearing member and the frame such that the developer does not leak from the gap between the developer bearing member and the frame, and a sealing portion that seals a gap between the frame and the seal member such that the developer does not leak from the gap between the frame and the seal member, wherein the frame is provided with an injection inlet for injecting elastomer for forming the sealing portion, a storage portion in which the elastomer spilling out of space in which the sealing portion is formed is stored, and a protruding portion that protrudes toward a conveyance path of a recording medium to which the developer image is transferred, and the protruding portion protrudes toward the conveyance path further than the storage portion exposed to the conveyance path.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

(Embodiment)

Hereinbelow, the embodiment will be described in detail by using the drawings. First, the overall configuration of an image forming apparatus X and an image forming process will be described by using FIGS. 2 and 3.

Figure 2:
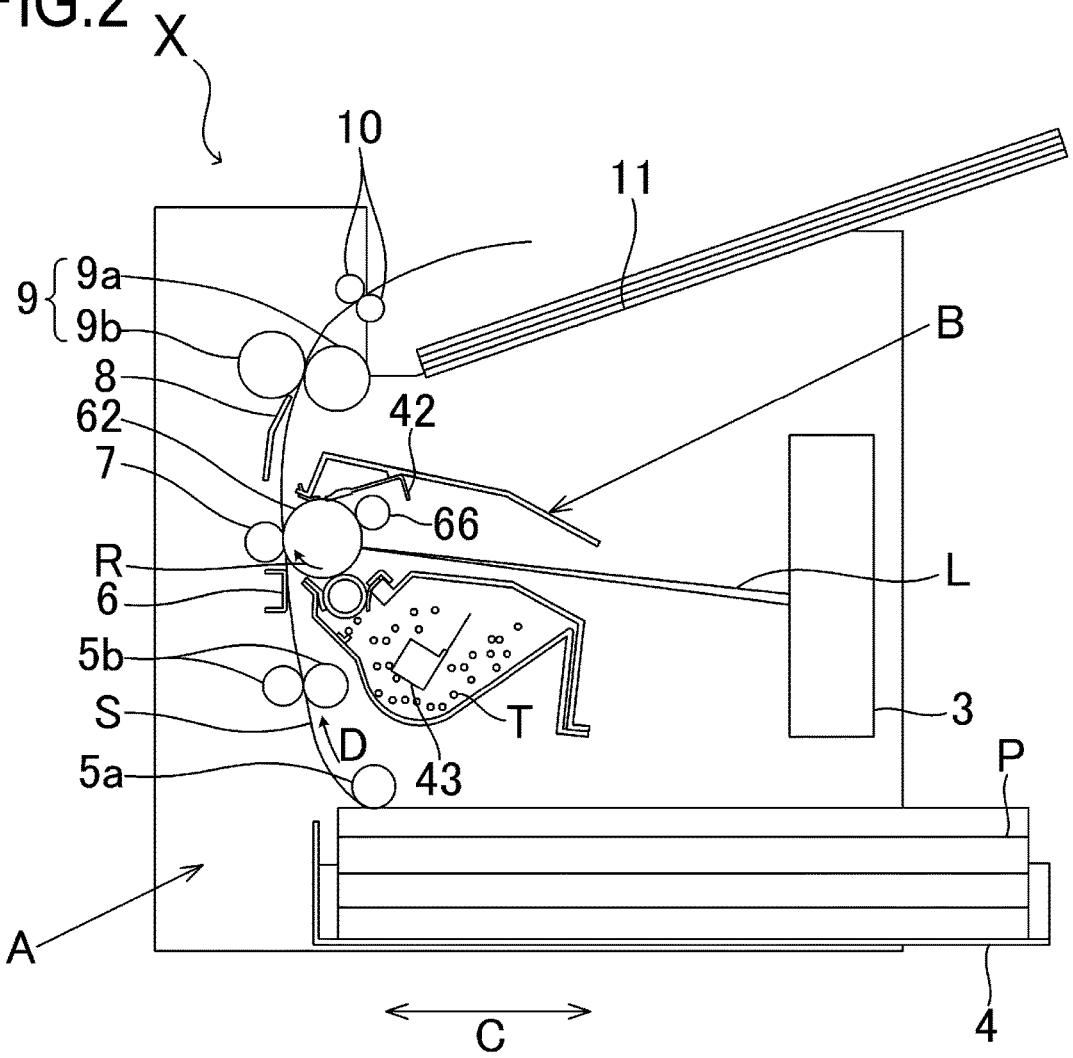
FIG. 2 is a schematic cross-sectional view of the image forming apparatus according to the embodiment.
Figure 3:
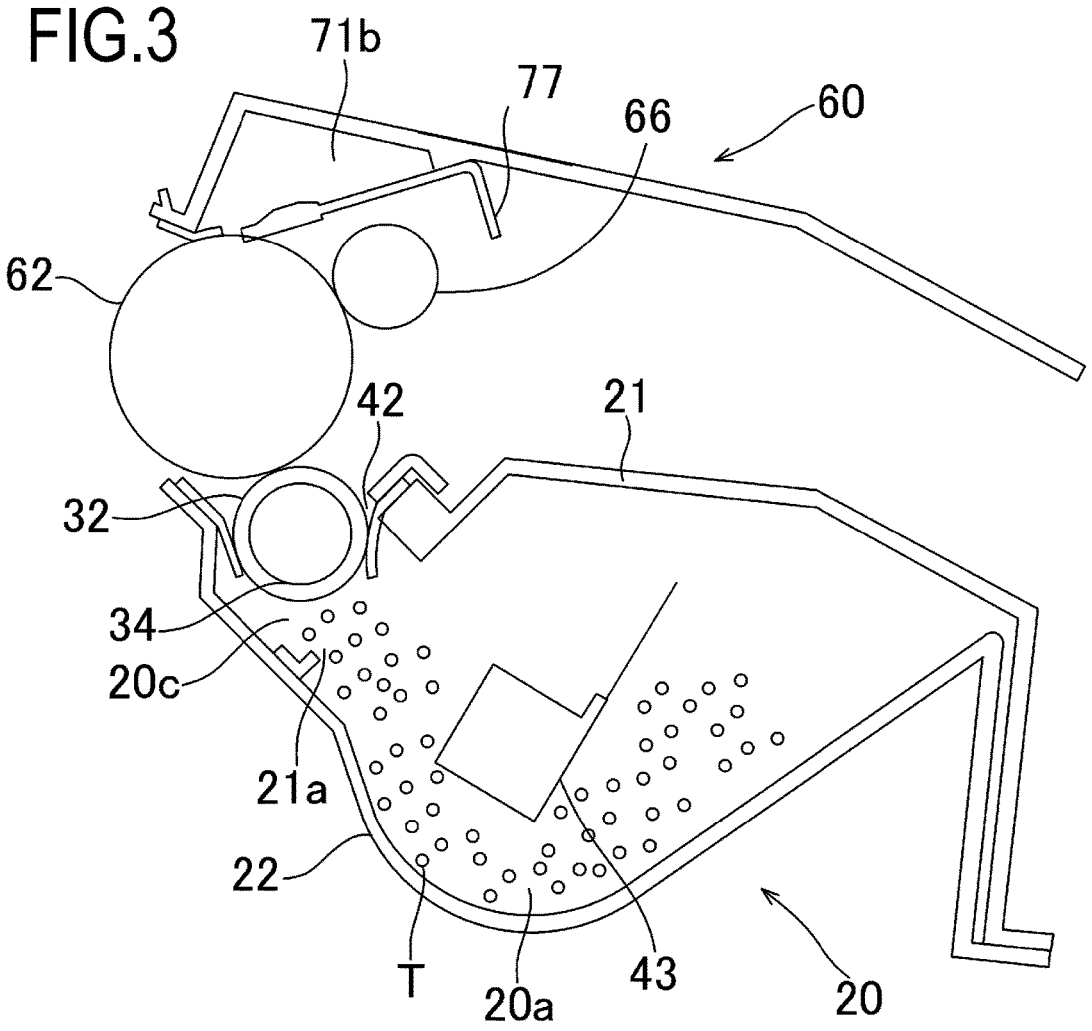
FIG. 3 is a schematic cross-sectional view of a cartridge according to the embodiment.

FIG. 2 is a schematic cross-sectional view of the image forming apparatus X according to the embodiment. FIG. 3 is a schematic cross-sectional view of a cartridge B as a process cartridge according to the embodiment.

Note that, in the present embodiment, the direction of the rotation center axis of an electrophotographic photosensitive drum (hereinafter referred to as a drum 62) as an image bearing member is a longitudinal direction. In addition, a direction that is orthogonal to the longitudinal direction and corresponds to the direction of an arrow C in FIG. 2 is a lateral direction. Further, in the longitudinal direction, a side on which the drum 62 receives a driving force from an apparatus main body A is a driving side, and a side opposite to the driving side is a non-driving side. The apparatus main body A is a portion obtained by removing the cartridge B from the image forming apparatus X.

<Overall Configuration of Image Forming Apparatus X>

The image forming apparatus X shown in FIG. 2 is a laser beam printer that uses electrophotographic techniques and in which the cartridge B is detachably attached to the apparatus main body A. In the image forming apparatus X, an exposure apparatus 3 (laser scanner unit) for forming an electrostatic latent image on the drum 62 in the cartridge B is disposed. In addition, below the cartridge B, a sheet tray 4 in which a sheet P as a recording medium is stored is disposed. Further, a pickup roller 5*a*, a conveyance roller pair 5*b*, a transfer guide 6, a transfer roller 7, a conveyance guide 8, a fixing apparatus 9, a discharge roller pair 10, a discharge tray 11 and the like are disposed in this order along a conveyance direction D of the sheet P in the apparatus main body A. Note that the fixing apparatus 9 is constituted by a heat roller 9*a* and a pressure roller 9*b*.

<Image Forming Process>

Next, an image forming process will be described. In the case where the image forming process is executed, first, the drum 62 is rotationally driven in a direction of an arrow R at a predetermined circumferential speed (process speed) based on a print start signal. A charging roller 66 to which a bias voltage is applied comes into contact with the outer peripheral surface of the drum 62, and uniformly charges the outer peripheral surface of the drum 62. The exposure apparatus 3 outputs a laser beam L in accordance with image information. Scanning exposure is performed on the outer peripheral surface of the drum 62 with the laser beam L. With this, the electrostatic latent image corresponding to the image information is formed on the outer peripheral surface of the drum 62.

On the other hand, as shown in FIG. 3, in a developing apparatus unit 20 as a developing apparatus, toner T as a developer in a toner storage portion 20*a* is stirred and conveyed by the rotation of a conveyance member 43, and is conveyed to a developing chamber 20*c* through a developing opening 21*a*. Subsequently, the toner T is carried by the surface of the developing roller 32 as a developer bearing member by the magnetic force of a magnet roller (fixed magnet). The toner T is subjected to triboelectric charging by a developing blade 42, and the layer thickness of the toner T is controlled on the outer peripheral surface of the developing roller 32. The toner T adheres to the electrostatic latent image formed on the drum 62, and the electrostatic latent image on the drum 62 is developed as a toner image that serves as a developer image.

In addition, as shown in FIG. 2, the sheet P stored in the lower portion of the apparatus main body A is sent out from the sheet tray 4 by the pickup roller 5*a* and the conveyance roller pair 5*b* at the timing of output of the laser beam L. Subsequently, the sheet P is guided by the transfer guide 6, and is conveyed to a transfer position between the drum 62 and the transfer roller 7. At the transfer position, the toner image is successively transferred to the sheet P from the drum 62.

The sheet P to which the toner image is transferred is separated from the drum 62, and is guided by the conveyance guide 8 and conveyed to the fixing apparatus 9. Subsequently, the sheet P passes through a nip portion of the heat roller 9*a* and the pressure roller 9*b* in the fixing apparatus 9. In the nip portion, the sheet P is pressurized and heated, and the toner image is thereby fixed to the sheet P. The sheet P to which the toner image is fixed is conveyed toward the discharge roller pair 10, and is discharged to the discharge tray 11 by the discharge roller pair 10.

On the other hand, as shown in FIG. 3, residual toner remaining on the drum 62 after the toner image is transferred to the sheet P is removed by a cleaning blade 77, and is reused in the image forming process. Note that the residual toner removed from the drum 62 is stored in a waste toner chamber 71*b* in the cleaning unit 60. Note that, in the above description, the charging roller 66, the developing roller 32, the transfer roller 7, the cleaning blade 77 and the like are process means that act on the drum 62.

<With Regard to Attachment and Detachment of Cartridge B>

Figure 4:
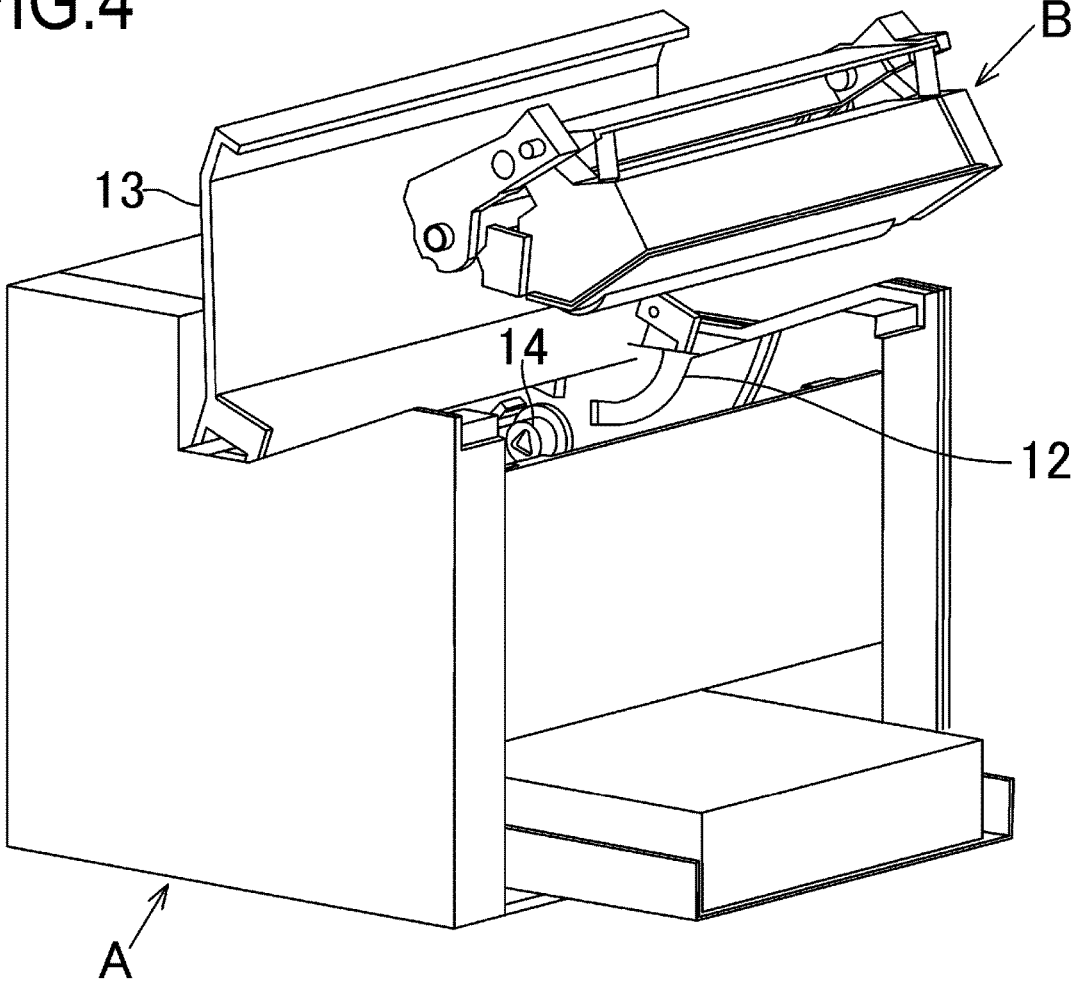
FIG. 4 is a perspective view showing an apparatus main body with a door being opened and the cartridge.

Next, attachment and detachment of the cartridge B to and from the apparatus main body A will be described by using FIG. 4. FIG. 4 is a perspective view showing the apparatus main body A with a door 13 being opened and the cartridge B. The door 13 is pivotably attached to the apparatus main body A. When the door 13 is opened, a guide rail 12 is provided, and the cartridge B is attached along the guide rail 12 in the apparatus main body A. A drive shaft 14 driven by a motor (not shown) of the apparatus main body A engages with a driving force receiving portion 63*a* (see FIG. 6) provided in the cartridge B. With this, the drum 62 that is coupled to the driving force receiving portion 63*a* receives the driving force from the apparatus main body A and rotates. Further, the charging roller 66 and the developing roller 32 (see FIG. 7) are supplied with electric power by a power supply portion (not shown) of the apparatus main body A.

<Overall Configuration of Cartridge B>

Figure 5:
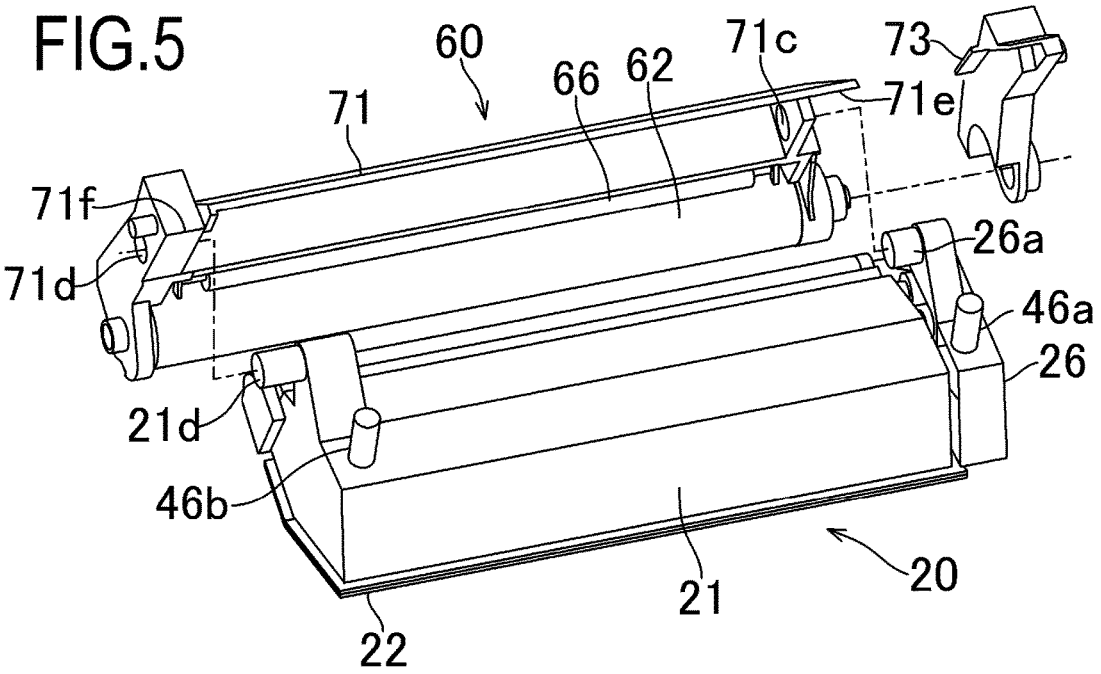
FIG. 5 is an exploded perspective view of the cartridge according to the embodiment.
Figure 6:
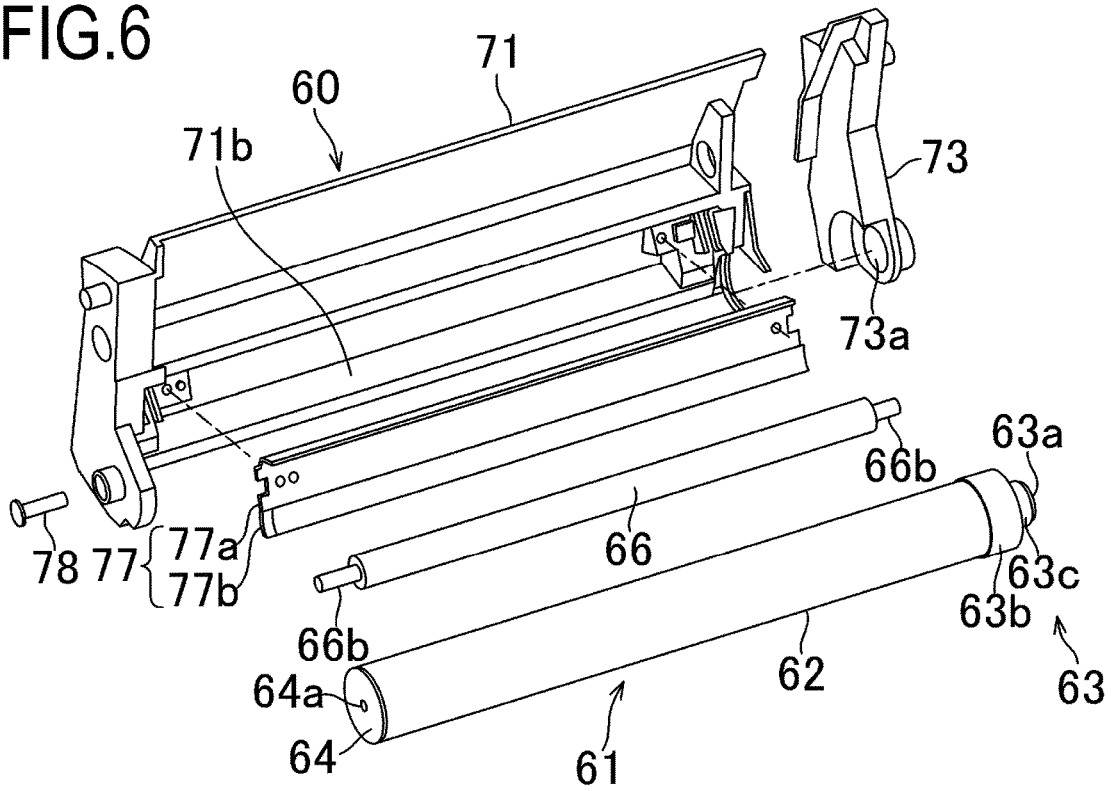
FIG. 6 is a view showing the configuration of a cleaning unit according to the embodiment.
Figure 7:
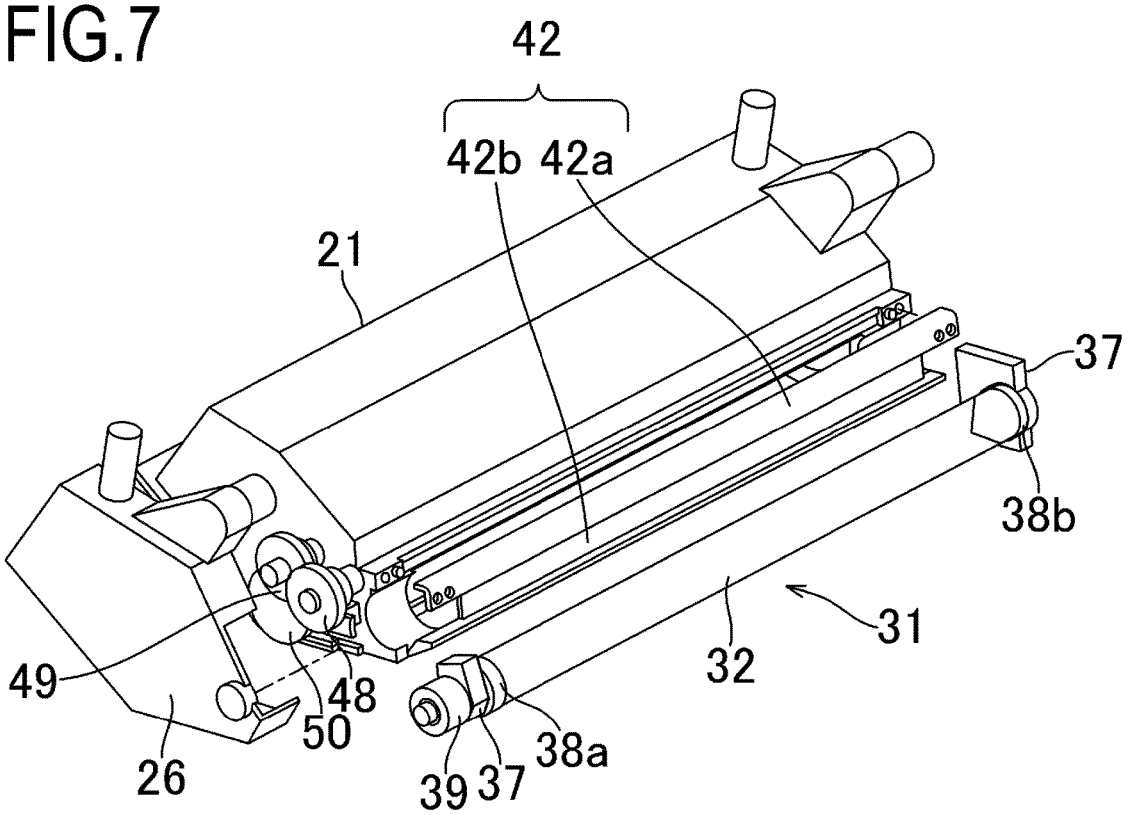
FIG. 7 is a view showing the configuration of a developing apparatus unit according to the embodiment.

Next, the overall configuration of the cartridge B will be described by using FIGS. 5, 6, and 7. FIG. 5 is an exploded perspective view of the cartridge B according to the embodiment. FIG. 6 is a view showing the configuration of the cleaning unit 60 according to the embodiment. FIG. 7 is a view showing the configuration of the developing apparatus unit 20 according to the embodiment.

First, the configuration of the cartridge B will be described by using FIG. 5. The cartridge B is constituted by the developing apparatus unit 20 and the cleaning unit 60. The developing apparatus unit 20 is constituted by a toner storage frame 21 as a first frame, a lid member 22 as a second frame, a side member 26, the developing blade 42 (see FIG. 3), the developing roller (see FIG. 3) and the like. In the side member 26, a first supported portion 26*a* for rotatably supporting a cleaning frame 71 is provided on the driving side. In addition, in the toner storage frame 21, a second supported portion 21*d* for rotatably supporting the cleaning frame 71 is provided on the non-driving side. Herein, in the present embodiment, the toner storage frame 21 and the lid member 22 that are combined together correspond to a frame.

On the other hand, the cleaning unit 60 is constituted by the cleaning frame 71, the drum 62, the charging roller 66, the cleaning blade 77 and the like. In the cleaning frame 71, a first supporting portion 71*c* and a second supporting portion 71*d* for rotatably supporting the developing apparatus unit 20 are provided. As shown in FIG. 5, the first supported portion 26*a* of the side member 26 engages with the first supporting portion 71*c* of the cleaning frame 71, and the second supported portion 21*d* of the toner storage frame 21 engages with the second supporting portion 71*d* of the cleaning frame 71. With this, the developing apparatus unit 20 is supported rotatably relative to the cleaning unit 60.

Further, a drum bearing 73 is fixed to the cleaning frame 71, whereby the drum 62 is rotatably supported, and the developing apparatus unit 20 and the cleaning unit 60 are positioned in the longitudinal direction. In addition, in the side member 26, a biasing member 46*a* is provided on the driving side. In the toner storage frame 21, a biasing member 46*b* is provided on the non-driving side. The biasing member 46*a* is configured so as to abut on a spring seat 71*e* provided in the cleaning frame 71, and the biasing member 46*b* is configured so as to abut on a spring seat 71*f* provided in the cleaning frame 71. With this, the developing apparatus unit 20 is reliably biased in a direction toward the cleaning unit 60. In addition, as shown in FIG. 7, a distance maintaining member 38*a* and a distance maintaining member 38*b* are provided in both end portions of the developing roller 32, and they abut on the surface of the drum 62 and the distance between the developing roller 32 and the drum 62 is thereby maintained at a constant distance.

<Configuration of Cleaning Unit>

Next, the configuration of the cleaning unit 60 will be described by using FIG. 6. The cleaning blade 77 includes a supporting member 77*a* formed of sheet metal and an elastic member 77*b* formed of an elastic material such as urethane rubber, and both ends of the supporting member 77*a* are fixed to the cleaning frame 71 at predetermined positions using screws (not shown). The elastic member 77*b* abuts on the drum 62, and the residual toner is thereby removed from the outer peripheral surface of the drum 62. The removed toner is stored in the waste toner chamber 71*b* of the cleaning unit 60.

A shaft portion 66*b* of the charging roller 66 is biased in a direction toward the drum 62 and is rotatably supported by a bearing member (not shown) attached to the cleaning frame 71. The drum 62 is integrally coupled to a flange 64 and a flange 63 to thereby constitute a drum unit 61. Note that the method for coupling the drum 62 to the flanges 64 and 63 includes swaging, bonding, welding and the like.

In addition, to the flange 64, a grounding contact (not shown) or the like is coupled. Further, in the flange 63, the driving force receiving portion 63*a* that receives the driving force from the apparatus main body A, a gear portion 63*b* that transmits the driving force to the developing roller 32, and a supported portion 63*c* that is rotatably supported by the drum bearing 73 are provided. In the drum unit 61, the supported portion 63*c* is supported by a supporting portion 73*a* of the drum bearing 73, and the supported portion 64*a* of the flange 64 is rotatably supported by being supported by a drum shaft 78 that is press-fitted into the cleaning frame 71.

<With Regard to Configuration of Developing Apparatus Unit 20>

Next, the configuration of the developing apparatus unit 20 according to the present embodiment will be described. First, the schematic configuration of developing means or the like that constitutes the developing apparatus unit 20 will be described by using FIG. 7.

(Schematic Description of Developing Apparatus Unit)

The developing blade 42 is constituted by a supporting member 42*a* formed of sheet metal and an elastic member 42*b* formed of an elastic material such as urethane rubber, and both ends thereof are fixed to the toner storage frame 21 at predetermined positions using screws (not shown). In addition, the elastic member 42*b* abuts on the developing roller 32, whereby the amount of the toner on the outer peripheral surface of the developing roller 32 is controlled and a triboelectric charge is provided to the toner.

A developing roller unit 31 is constituted by the developing roller 32, the magnet roller 34 (see FIG. 3), the distance maintaining members 38 (the distance maintaining member 38*a* and the distance maintaining member 38*b*), bearing members 37, a developing roller gear 39 and the like. The distance maintaining members 38 are attached to both end portions of the developing roller 32. The bearing members 37 are disposed outside the distance maintaining members 38, and the developing roller gear 39 is incorporated into a portion outside the distance maintaining member 38 on the driving side. In addition, the bearing members 37 rotatably support the developing roller 32, and are fixed to the toner storage frame 21. A first gear 48 and a second gear 49 as drive transmission members are rotatably attached to the toner storage frame 21, and are configured so as not to be disconnected in the longitudinal direction by fixing the side member 26 to the toner storage frame 21. With this, the gear portion 63*b* (see FIG. 6), the developing roller gear 39, the first gear 48, the second gear 49, and a conveyance gear 50 connected to the conveyance member 43 mesh with each other sequentially, and the driving force received from the apparatus main body A is thereby transmitted to the developing roller 32 and the conveyance member 43 (see FIG. 3).

(With Regard to Configurations of Frame and Seal Member 47 of Developing Apparatus Unit 20)

Figure 8:
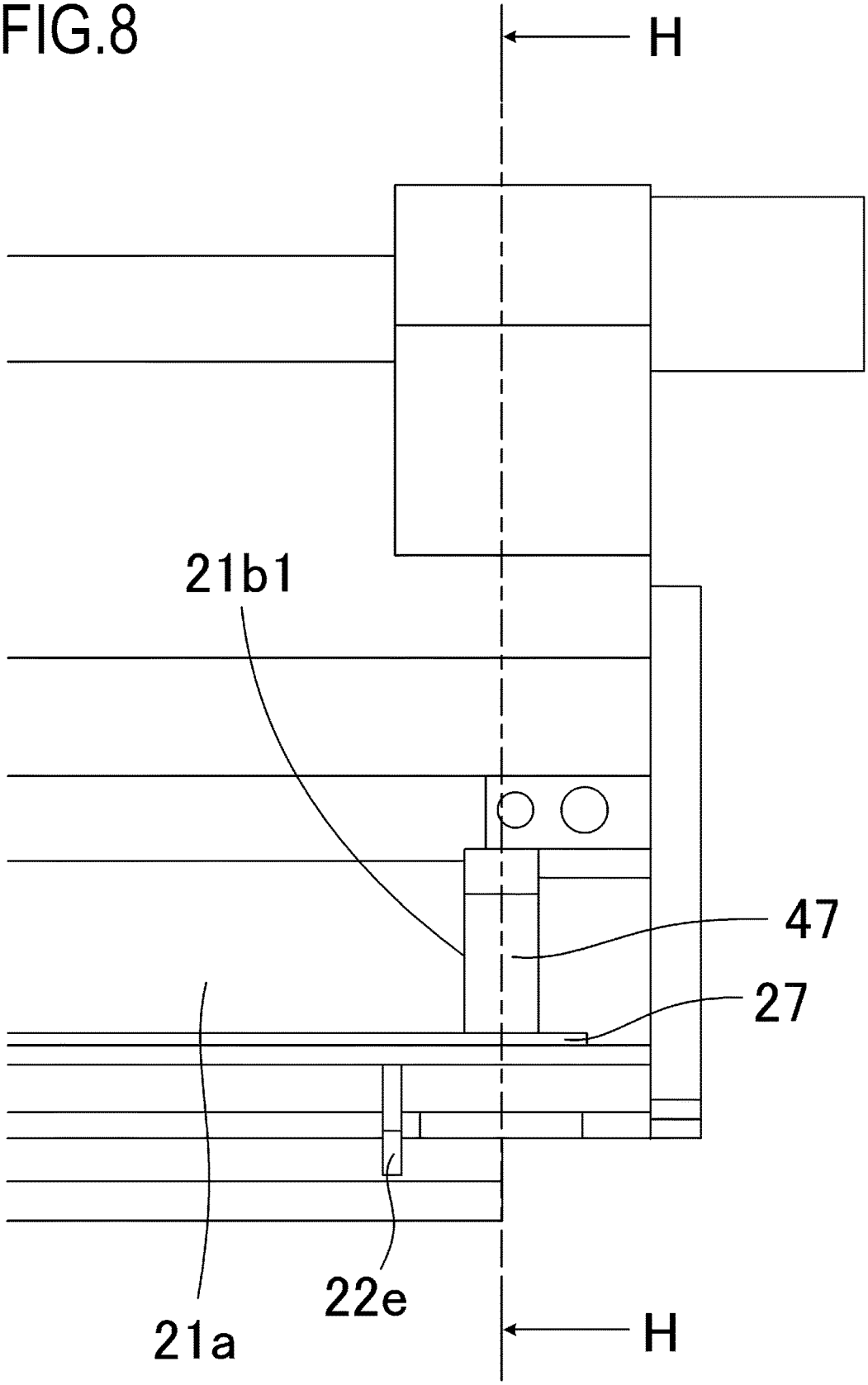
FIG. 8 is a schematic cross-sectional view showing a portion to which a seal member is attached.
Figure 9:
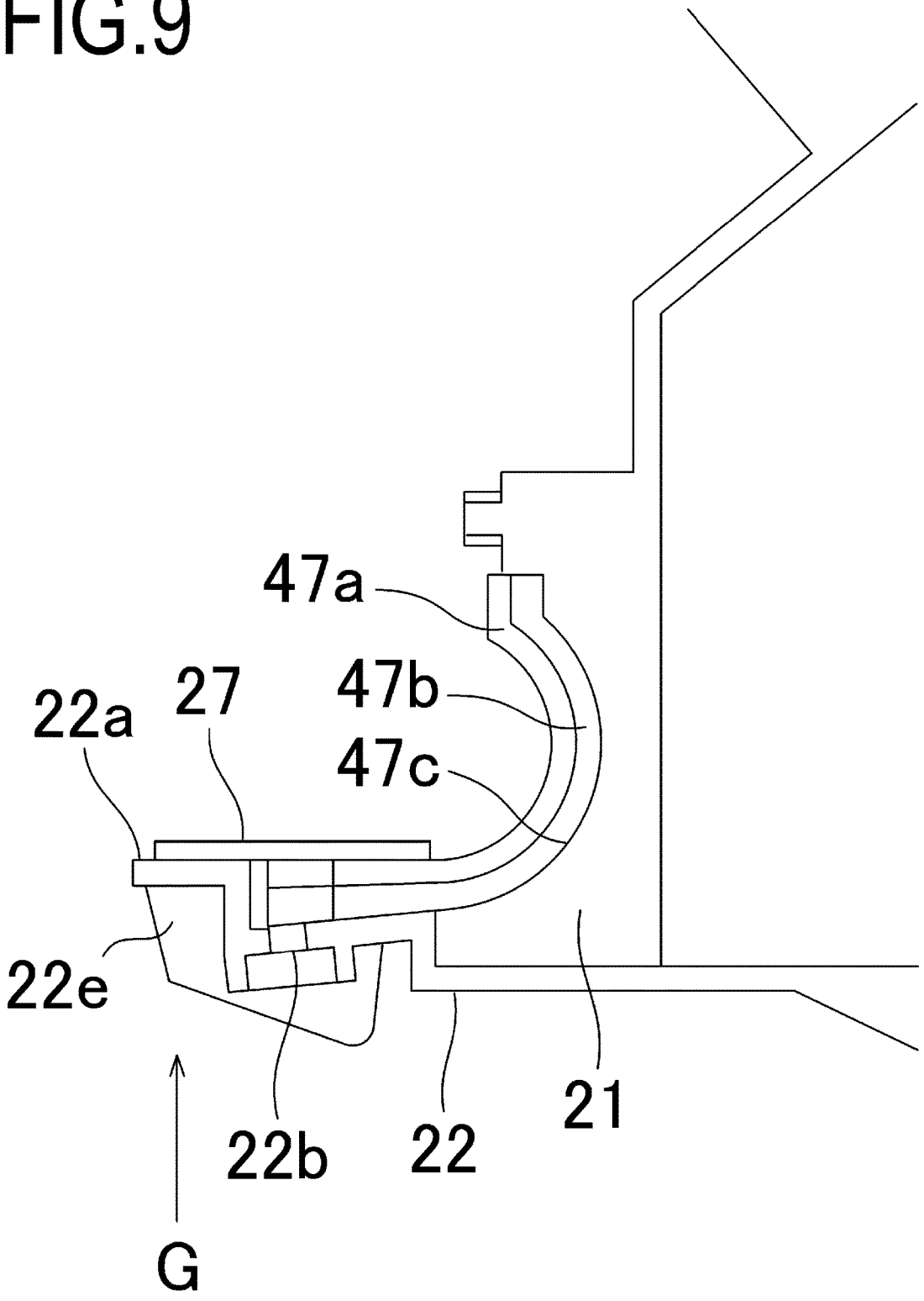
FIG. 9 is a schematic partial cross-sectional view of a toner storage frame and a lid member.

Next, the configuration of each of the toner storage frame 21, the lid member 22, and a seal member 47 according to the present embodiment will be described. First, the seal member 47 will be described by using FIGS. 8 and 9. FIG. 8 is a schematic cross-sectional view showing a portion to which the seal member 47 is attached. FIG. 9 is a cross-sectional view taken along the line H-H that intersects the longitudinal direction of each of the toner storage frame 21 and the lid member 22 in FIG. 8. Note that FIG. 8 shows only the non-driving side, but the driving side also has the same configuration.

As described above, with regard to a developing frame that constitutes the developing apparatus unit 20, by welding the toner storage frame 21 as the first frame having the developing opening 21*a* and the lid member 22 as the second frame together, the toner storage portion 20*a* and the developing chamber 20*c* are formed (see FIG. 3). Note that the width of the developing opening 21*a* in the longitudinal direction is set to the conceivable maximum width of the sheet P or more such that the toner is supplied to the sheet P as the recording medium.

As shown in FIG. 8, to an end portion 21*b*1 in the developing opening 21*a*, the seal member 47 is attached. In addition, as shown in FIG. 9, the seal member 47 is constituted by two layers of an elastic member 47*b* and a fiber pile 47*a*, and is fixed to the toner storage frame 21 using a double-sided tape 47*c*. The fiber pile 47*a* abuts on the developing roller 32, and the leakage of the toner from both end portions of the developing roller 32 is thereby prevented. On a sheet bearing surface 22*a* of the lid member 22, a sheet member 27 formed of PET is disposed so as to abut on the developing roller 32. With this, the leakage of the toner from the gap between the developing roller 32 and the lid member 22 is prevented over the longitudinal direction.

Figure 1:
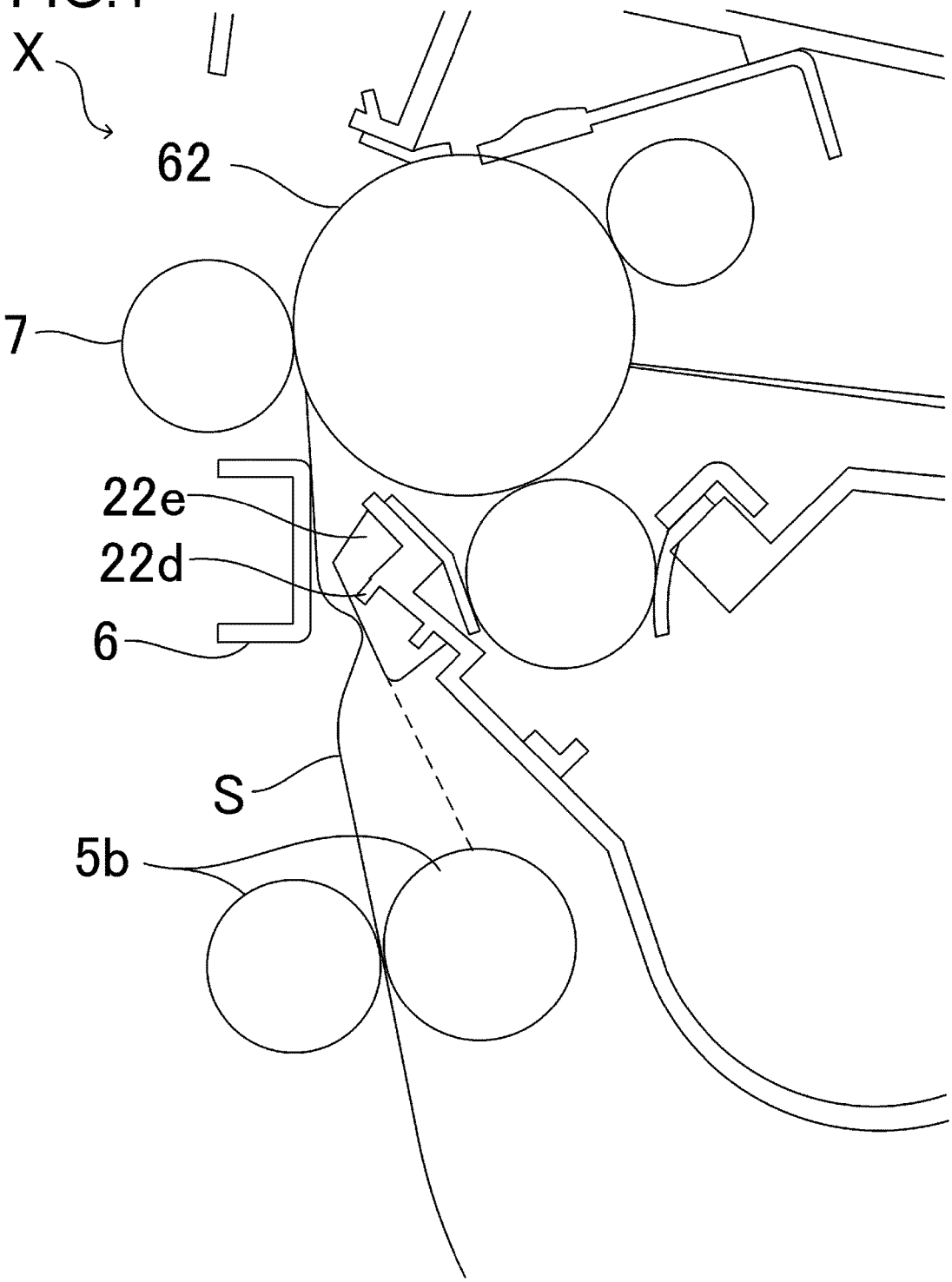
FIG. 1 is a partial cross-sectional view of an image forming apparatus according to an embodiment.
Figure 10:
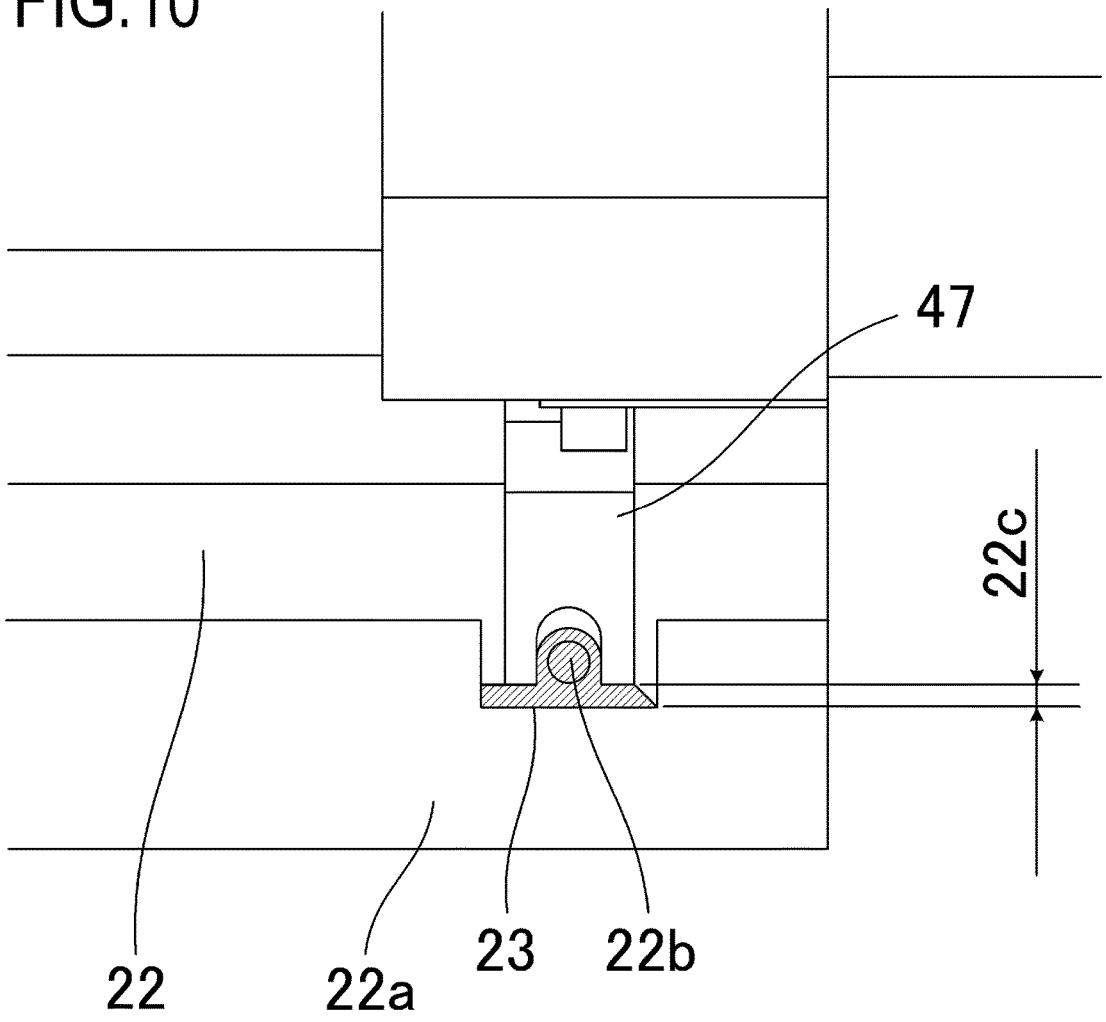
FIG. 10 is a view showing a state in which elastomer according to the embodiment is injected.
Figure 11:
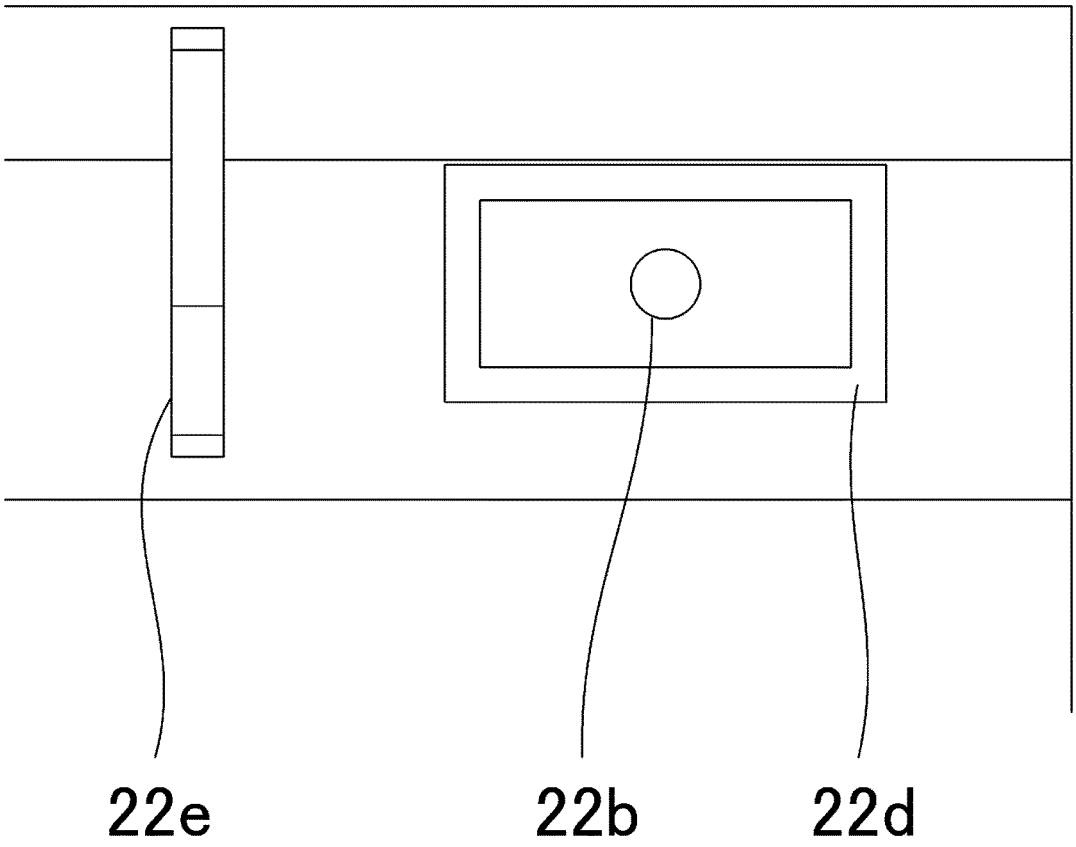
FIG. 11 is a view showing a buffer portion according to the embodiment.
Figure 12:
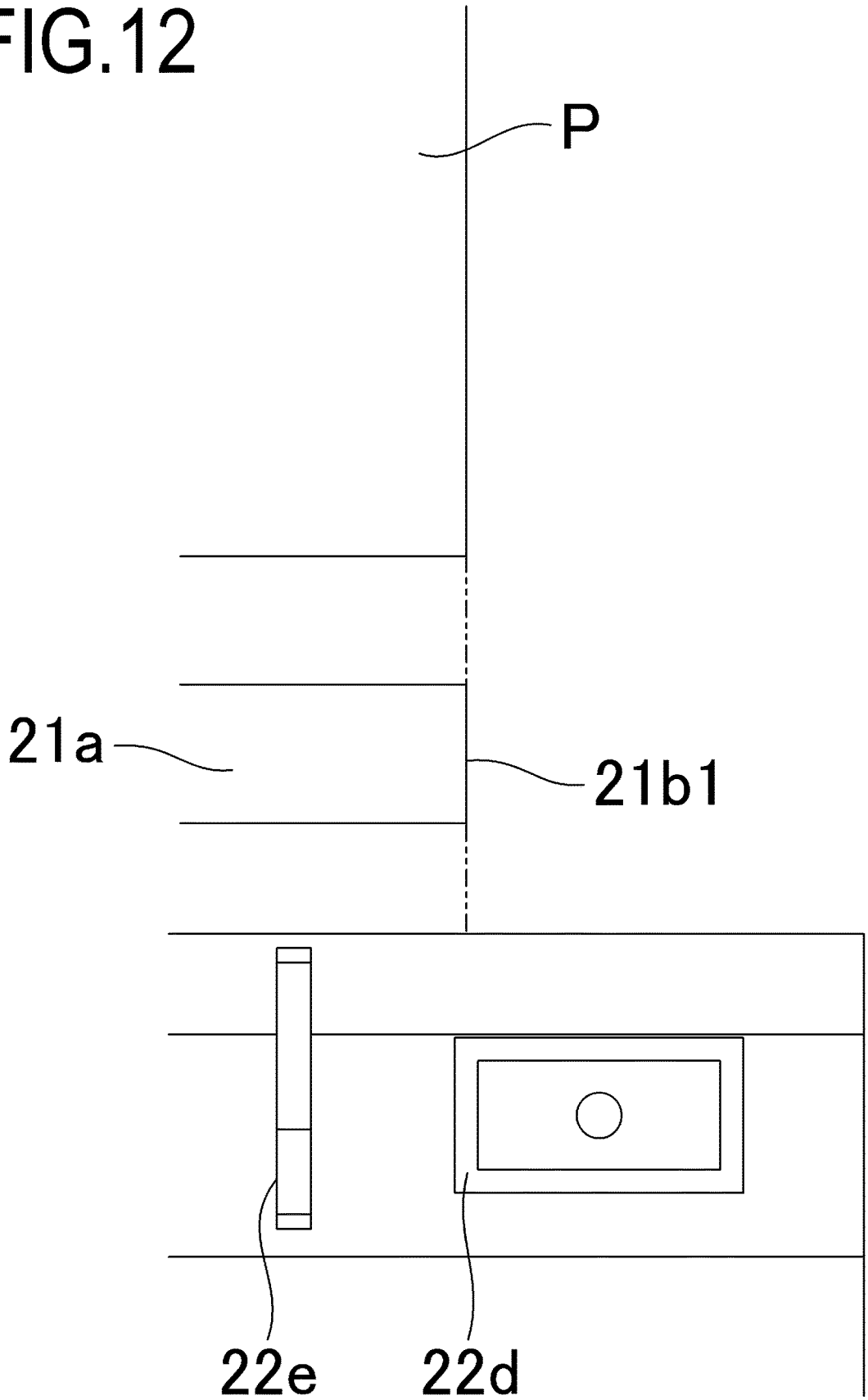
FIG. 12 is a view showing the positional relationship among a sheet, a developing opening, a paper conveying rib, and the buffer portion.

Next, elastomer as a liquid injected member and a paper conveying rib 22*e* as a protruding portion according to the present embodiment will be described by using FIG. 1 and FIGS. 10 to 12. FIG. 1 is a partial cross-sectional view of the image forming apparatus X in a state in which the cartridge B according to the present embodiment is inserted into the apparatus main body A. FIG. 10 is a view showing a state in which the elastomer according to the embodiment is injected. FIG. 11 is a view showing a buffer portion 22*d* as a storage portion according to the embodiment. FIG. 12 is a view showing the positional relationship among the sheet P, the developing opening 21*a*, the paper conveying rib 22*e*, and the buffer portion 22*d*.

In the present embodiment, as shown in FIG. 10, the leakage of the toner is prevented by forming a sealing portion 23 by injecting the elastomer into a gap 22*c* between the seal member 47 and the lid member 22 that is formed due to, for example, the part accuracy of the seal member 47 or an error at the time of assembly. Specifically, an injection portion 22*b* as the injection inlet of the elastomer is provided in the lid member 22, and the elastomer is injected from the back surface side (from a G direction in FIG. 9) of the surface of the lid member 22 that is in contact with the toner. The elastomer is injected after the sheet member 27 is stuck to the sheet bearing surface 22*a* of the lid member 22. Subsequently, as shown in FIG. 11, the buffer portion 22*d* is provided around the injection portion 22*b* such that the elastomer that becomes redundant due to variations in the size of space in which the sealing portion 23 is formed does not jut out from the contour of the lid member 22. In the present embodiment, the buffer portion 22*d* is configured so as to be formed into a substantially rectangular shape to surround the injection portion 22*b* using a rib. In addition, as shown in FIG. 1, the buffer portion 22*d* is exposed to a paper path S as a conveyance path in which the sheet P is conveyed, and protrudes toward the paper path S. In the present embodiment, since the buffer portion 22*d* surrounds the injection portion 22*b*, even when the elastomer spills out of the injection portion 22*b* to the side of the buffer portion 22*d*, it is possible to prevent the elastomer having spilled out from jutting out from the contour of the developing apparatus unit 20. In addition, with the buffer portion 22*d* that surrounds the injection portion 22*b*, the elastomer having spilled out adheres to the inner wall of the buffer portion 22*d*, and hence it is possible to prevent the elastomer from jutting out from the contour of the developing apparatus unit 20.

In addition, in the present embodiment, as shown in FIG. 12, the paper conveying rib 22*e* is provided inwardly of the buffer portion 22*d* in the longitudinal direction on the back surface of the lid member 22, similarly to the buffer portion 22*d*. Specifically, the paper conveying rib 22*e* protrudes toward the paper path S further than the buffer portion 22*d* such that the sheet P does not come into contact with the buffer portion 22*d*. In addition, the paper conveying rib 22*e* is provided at a position that prevents the sheet P from coming into contact with the buffer portion 22*d*. The paper conveying rib 22*e* is provided inwardly of the end portion 21*b*1 of the developing opening 21*a* in the longitudinal direction. That is, the paper conveying rib 22*e* overlaps the sheet P as viewed from the direction of protrusion of the paper conveying rib 22*e* when the sheet P passes through the paper conveying rib 22*e*. Further, as shown in FIG. 1, the paper conveying rib 22*e* is inclined so as to approach the paper path S with approach to the downstream side in the direction in which the sheet P is conveyed. Note that, in the present embodiment, the paper conveying rib 22*e* has a shape that extends along the conveyance direction of the sheet P, and also plays a role in guiding the sheet P toward the direction in which the sheet P is to be conveyed. Note that, in the present embodiment, one of the two paper conveying ribs 22*e* and the other of the two paper conveying ribs 22*e* are disposed between the two buffer portions 22*d* in the direction of the rotation center axis of the developing roller 32. In addition, in the present embodiment, the buffer portion 22*d* is provided in the vicinity of each of both ends of the developing roller 32 in the direction of the rotation center axis of the developing roller 32. Further, the paper conveying rib 22*e* is also provided in the vicinity of each of the both ends of the developing roller 32 in the direction of the rotation center axis of the developing roller 32.

As shown in FIG. 1, in the present embodiment, in the case where the curled sheet P is conveyed not to the side of the transfer guide 6 but to the side of the buffer portion 22*d* after passing through the conveyance roller pair 5*b*, the paper conveying rib 22*e* guides the sheet P to the side of the transfer guide 6. That is, according to the present embodiment, by providing the paper conveying rib 22*e*, it is possible to prevent the sheet P from colliding with the buffer portion 22*d* to cause jamming even in the case where the sheet P is curled.

Thus, in the present embodiment, the paper conveying rib 22*e* protrudes toward the paper path S further than the buffer portion 22*d* such that the sheet P does not come into contact with the buffer portion 22*d*. With this, in the case where the buffer portion 22*d* is exposed to the path of the sheet P, it is possible to prevent the sheet P from coming into contact with the buffer portion 22*d* to thereby cause the jamming.

In addition, in the present embodiment, the paper conveying rib 22*e* is capable of guiding the sheet P toward the direction in which the sheet P is to be conveyed.

Further, in the present embodiment, the paper conveying rib 22*e* approaches the paper path S as the paper conveying rib 22*e* extends in the conveyance direction of the sheet P. With this, it is possible to guide the sheet P toward the direction in which the sheet P is to be conveyed.

In addition, in the present embodiment, the paper conveying rib 22*e* is formed by extending part of the buffer portion 22*d* toward the paper path S. Part of the buffer portion 22*d* serves as the paper conveying rib 22*e*, whereby it is possible to save a material for forming the paper conveying rib 22*e*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118005, filed Jun. 14, 2016, which is hereby incorporated by reference herein in its entirety.

What is claimed is:

1. A process cartridge detachably attached to an apparatus main body of an image forming apparatus for forming an image on a recording medium, the apparatus main body including a conveyance member configured to convey the recording medium, the process cartridge comprising:

a developer bearing member that carries a developer;

a frame by which the developer bearing member is rotatably supported;

a seal member that extends in a crossing direction crossing a rotational axis direction of the developer bearing member and is fixed on a first surface of the frame so as to seal a first gap between an end portion of the developer bearing member in the rotational axis direction and the frame; and a sealing portion that seals a second gap between the frame and an end portion of the seal member in the crossing direction, the frame includes:

an injection inlet through which elastomer has been injected into the second gap for forming the sealing portion;

a storage portion that is a space surrounded by a second surface of the frame opposite to the first surface of the frame and a wall protruding from the second surface of the frame and in which any elastomer spilling out of the second gap is stored, and a protruding portion that protrudes, from the second surface of the frame, further than the wall of the storage portion in a direction in which the wall protrudes, the protruding portion being arranged so as to overlap the storage portion when viewed in the rotational axis direction, and wherein the protruding portion is configured to contact the recording medium conveyed by the conveyance member when the process cartridge is mounted in the apparatus main body of the image forming apparatus.

2. The process cartridge according to claim 1, wherein the protruding portion is arranged so as to prevent the recording medium conveyed by the conveyance member from coming into contact with the elastomer stored in the storage portion.

3. The process cartridge according to claim 1, wherein the protruding portion extends in a direction along a conveyance direction in which the recording medium is to be conveyed by the conveyance member and is configured to guide the recording medium when the process cartridge is mounted in the apparatus main body of the image forming apparatus.

4. The process cartridge according to claim 1, wherein the protruding portion is arranged so as to overlap the recording medium as viewed in a direction in which the protruding portion protrudes when the recording medium passes through the protruding portion.

5. The process cartridge according to claim 1, wherein the frame includes a pair of storage portions and a pair of protruding portions, the pair of storage portions are provided in one end and the other end of the developer bearing member in the rotational axis direction, respectively, and the pair of protruding portions are also provided in one end and the other end of the developer bearing member in the rotational axis direction, respectively.

6. The process cartridge according to claim 5, wherein one of the pair of protruding portions and the other of the pair of protruding portions are disposed between one of the pair of storage portions and the other of the pair of storage portions in the rotational axis direction.

7. An image forming apparatus for forming an image on a recording medium, the image forming apparatus comprising:

a conveyance member configured to convey the recording medium;

an image bearing member on which a developer image is formed;

a developer bearing member that bears a developer and supplies the developer to the image bearing member;

a frame by which the developer bearing member is rotatably supported;

a seal member that extends in a crossing direction crossing a rotational axis direction of the developer bearing member and is fixed on a first surface of the frame so as to seal a first gap between an end portion of the developer bearing member in the rotational axis direction and the frame; and a sealing portion that seals a second gap between the frame and an end portion of the seal member in the crossing direction, wherein the frame includes:

an injection inlet through which elastomer has been injected into the second gap for forming the sealing portion;

a storage portion that is a space surrounded by a second surface of the frame opposite to the first surface of the frame and a wall protruding from the second surface of the frame and in which any elastomer spilling out of the second gap is stored, and a protruding portion that protrudes, from the second surface of the frame, further than the wall of the storage portion in a direction in which the wall protrudes, the protruding portion being arranged so as to overlap the storage portion when viewed in the rotational axis direction, wherein the protruding portion is configured to contact the recording medium conveyed by the conveyance member.

8. The process cartridge according to claim 1, further comprising an image bearing member to which the developer bearing member supplies the developer, wherein the protruding portion is a rib, a thickness direction of the rib being a direction along the rotational axis direction of the developer bearing member, a tip surface of the rib extending in a direction from a rotational center of the developer bearing member to a rotational center of the image bearing member on a cross section of the process cartridge orthogonal to the rotational axis direction of the developer bearing member.

9. The process cartridge according to claim 1, wherein the protruding portion is arranged inside the storage portion in the rotational direction of the developer bearing member.

10. The image forming apparatus according to claim 7, further comprising a transfer member forming a transfer nip, with the image bearing member, at which the image is transferred from the image bearing member to the recording medium while conveying the recording medium, wherein the conveyance member is configured to convey the recording medium to the transfer nip, and wherein the protruding portion is configured to contact with the recording medium conveyed in a conveyance path between the conveyance member and the transfer nip.

11. The image forming apparatus according to claim 7, wherein the protruding portion is a rib, a thickness direction of the rib being a direction along the rotational axis direction of the developer bearing member, a tip surface of the rib extending in a conveyance direction in which the recording medium is conveyed by the conveyance member.

12. The process cartridge according to claim 7, wherein the protruding portion is arranged inside the storage portion in the rotational direction of the developer bearing member.

13. A process cartridge detachably attached to an apparatus main body of an image forming apparatus for forming an image on a recording medium, the apparatus main body including a conveyance member configured to convey the recording medium, the process cartridge comprising:

a developer bearing member that carries a developer;

a frame by which the developer bearing member is rotatably supported;

a seal member that extends in a crossing direction crossing a rotational axis direction of the developer bearing member and is fixed on a first surface of the frame so as to seal a first gap between an end portion of the developer bearing member in the rotational axis direction and the frame; and a sealing portion that seals a second gap between the frame and an end portion of the seal member in the crossing direction, wherein the frame includes:

an injection inlet through which elastomer has been injected into the second gap for forming the sealing portion;

a storage portion that is a space surrounded by a second surface of the frame opposite to the first surface of the frame and a wall protruding from the second surface of the frame and in which any elastomer spilling out of the second gap is stored, and a protruding portion that protrudes, from the second surface of the frame, further than the wall of the storage portion in a direction in which the wall protrudes, wherein the protruding portion is configured to contact the recording medium conveyed by the conveyance member, and is arranged so as to prevent the recording medium conveyed by the conveyance member from contacting the elastomer stored in the storage portion when the process cartridge is mounted in the apparatus main body of the image forming apparatus.

14. An image forming apparatus for forming an image on a recording medium, the image forming apparatus comprising:

a conveyance member configured to convey the recording medium;

an image bearing member on which a developer image is formed;

a developer bearing member that bears a developer and supplies the developer to the image bearing member;

a frame by which the developer bearing member is rotatably supported;

a seal member that extends in a crossing direction crossing a rotational axis direction of the developer bearing member and is fixed on a first surface of the frame so as to seal a first gap between an end portion of the developer bearing member in the rotational axis direction and the frame; and a sealing portion that seals a second gap between the frame and an end portion of the seal member in the crossing direction, wherein the frame includes:

an injection inlet through which elastomer has been injected into the second gap for forming the sealing portion;

a storage portion that is a space surrounded by a second surface of the frame opposite to the first surface of the frame and a wall protruding from the second surface of the frame and in which the elastomer spilling out of the second gap is stored, and a protruding portion that protrudes, from the second surface of the frame, further than the wall of the storage portion in a direction in which the wall protrudes, wherein the protruding portion is configured to contact the recording medium conveyed by the conveyance member, and is arranged so as to prevent the recording medium conveyed by the conveyance member from contacting the elastomer stored in the storage portion.

* * * * *